United States Patent [19]

North

[11] 4,300,898

[45] Nov. 17, 1981

[54] COMPOSITIONS FOR TREATING TEXTILE FABRICS

[75] Inventor: Bernard F. North, Rock Hill, S.C.

[73] Assignee: Sun Chemical Corporation, New York, N.Y.

[21] Appl. No.: 187,720

[22] Filed: Sep. 16, 1980

Related U.S. Application Data

[63] Continuation-in-part of Ser. No. 92,630, Nov. 8, 1979.

[51] Int. Cl.[3] ..... D06M 13/34

[52] U.S. Cl. ..... 8/185; 8/115.6; 8/186; 528/245; 528/252; 528/259; 548/319

[58] Field of Search ..... 8/115.6, 185, 186; 528/252, 259, 245; 548/319

[56] References Cited

U.S. PATENT DOCUMENTS 3,260,565 7/1966 Beachem ..... 427/393.2
3,590,100 6/1971 Weiland ..... 8/182
3,671,307 6/1972 Spangler ..... 8/185
3,989,457 11/1976 Marte ..... 8/182

FOREIGN PATENT DOCUMENTS 53-44567 4/1978 Japan .

OTHER PUBLICATIONS

Mark, H et al., "Chemical Aftertreatment of Textiles," (Wiley, 1971), pp. 445–446.
Marsh, J. T., "Crease Resisting Fabrics" (Reinhold, 1962), pp. 74–75.

*Primary Examiner*—A. Lionel Clingman
*Attorney, Agent, or Firm*—Cynthia Berlow

[57] ABSTRACT

Blends of a glyoxal/cyclic urea condensate or a partially or wholly alkylated derivative thereof and dimethylol dihydroxyethylene urea or a partially or wholly alkylated derivative thereof improve the properties of textile fabrics treated therewith and contain only small amounts of free formaldehyde.

9 Claims, No Drawings

COMPOSITIONS FOR TREATING TEXTILE FABRICS

This application is a continuation-in-part of copending application Ser. No. 92,630 (filed Nov. 8, 1979) allowed.

This invention relates to textile finishing agents. More particularly it relates to finishing resins that impart permanent press characteristics to textile fabrics.

BACKGROUND OF THE INVENTION

The use of thermosetting resins or reactants to impart crease resistance and dimensional stability to textile materials is well-known in the art. These materials, known as "aminoplast resins," include the products of the reaction of formaldehyde with such compounds as urea, thiourea, ethylene urea, dihydroxyethylene urea, melamines, or the like. A serious drawback to the use of such materials is that they contain free formaldehyde. This is present during the preparation and storage of the finishing agent and its use in treating textiles, on the treated fabric, and on the finished garments. Also, when the fabrics or garments made therefrom are stored under humid conditions, additional free formaldehyde is produced.

The presence of even less than one percent of free formaldehyde, based on the total weight of the product, is undesirable, not only because of its unpleasant odor, but because it is an allergen and an irritant, causing severe reactions in the operators who manufacture the agent and who treat and handle the treated fabrics and to persons who handle and wear garments fabricated from the treated fabrics.

These problems associated with the presence of free formaldehyde on treated fabrics are well-known, and considerable efforts have been made to produce formaldehyde-free textile fabrics. One solution to the problem has been to employ scavengers for the free formaldehyde. In U.S. Pat. No. 3,590,100 cylic ethylene urea and propylene urea are disclosed in scavengers. Removal of the formaldehyde by reaction with phthalimide is disclosed in U.S. Pat. No. 3,723,058, and 4,127,382 teaches certain nitrogen-containing heterocyclic compounds as scavengers.

Treating textiles with resin compositions that do not contain or evolve formaldehyde is also known, as in U.S. Pat. No. 3,260,565, which teaches finishing agents formed by the reaction of alkyl or aryl ureas or thioureas with glyoxal. These agents, however, have the disadvantage of having marginal permanent press properties.

SUMMARY OF THE INVENTION

It has now been found that blends of a product of the reaction of glyoxal and at least one cyclic urea or a partially or wholly alkylated derivative thereof with dimethylol dihydroxyethylene urea (DMDHEU) or a partially or wholly alkylated derivative thereof are excellent crosslinking resins for textile fabrics and have a low potential for formaldehyde release.

DETAILED DESCRIPTION OF THE INVENTION

In accordance with the present invention, novel blends that are useful for crosslinking textile fabrics are prepared by (1) condensing in approximate stoichiometric quantities one or more cyclic ureas and glyoxal and, optionally, alkylating the resulting condensate and (2) adding thereto DMDHEU or a partially or wholly alkylated derivative thereof. The glyoxal/cyclic urea condensates alone and the alkylated glyoxal/cyclic urea condensates alone are satisfactory textile finishing agents and are free of formaldehyde. The DMDHEU alone is a good textile finishing agent but contains free formaldehyde. When the two resins are used together, they have good textile finishing characteristics and contain only a small amount of free formaldehyde.

The cyclic ureas which may be used have the following general formulas:

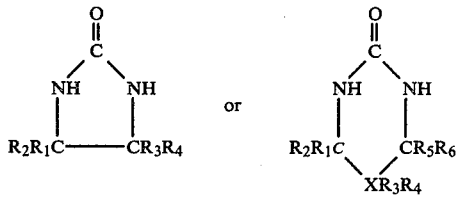

wherein $R_1$, $R_2$, $R_3$, $R_4$, $R_5$, and $R_6$ may be the same or different, and each may be H, OH, COOH, R, OR, or COOR wherein R is an alkyl or a substituted alkyl group having 1 to 4 carbon atoms, and X may be C, O, or N; when X is O, $R_3$ and $R_4$ are each zero; when X is N, $R_3$ or $R_4$ is zero.

Typical examples of such compounds include, but are not limited to, ethylene urea, propylene urea, uron, tetrahydro-5-(2-hydroxyethyl)-1,3,5-triazin-2-one, 4,5-dihydroxy-2-imidazolidinone, and the like, and mixtures of these.

The cyclic urea and the glyoxal are generally reacted in stoichiometric amounts, although a slight excess of either of the reactants may be employed. The general range of glyoxal:cyclic urea is about 0.8–1.2:1. The reaction may be carried out within the temperature range of room temperature up to reflux, but preferably is run at about 50° to 60° C. for about two hours. The pH may range from about 2 to 7.0, and preferably it is within the range of about 5.0 to 7.0. The product is a water-soluble oligomer that may be modified by partially or wholly alkylating it, e.g., with an alcohol such as methanol or ethanol.

The glyoxal/cyclic urea condensate or its alkylated derivative is then mixed with DMDHEU or an alkylated derivative thereof. The ratio of the amounts of glyoxal/cyclic urea condensate to DMDHEU is generally about 1:0.1–5, and preferably about 1:0.2–4.

The treating compositions of this invention are suitable for use with cellulosic textile fabrics, woven or non-woven, including 100% cellulose fabrics, e.g., cotton, rayon, and linen, as well as blends, e.g., polyester/cotton or polyester/rayon. Such blends preferably but not necessarily contain at least 20% of cellulose. Both white and colored (printed, dyed, yarn-dyed, cross-dyed, etc.) fabrics can be effectively treated with the resins of this invention. They are applicable also to fabrics containing fibers with free hydroxyl groups.

When applying the compositions of this invention to a fabric, there generally will be present an appropriate catalyst. Typical catalysts include acids (such as hydrochloric, sulfuric, fluoboric, acetic, glycolic, maleic, lactic, citric, tartaric, and oxalic acids); metal salts (such as magnesium chloride, nitrate, fluoborate, or fluosilicate; zinc chloride, nitrate, fluoborate, or fluosilicate; ammonium chloride; zirconium oxychloride; sodium or potassium bisulfate); amine hydrochlorides (such as the hydrochloride of 2-amino-2-methyl-1-propanol); and the like, and mixtures thereof. The amount of catalyst generally is about 0.01 to 10 percent, and preferably about 0.05 to 5 percent, based on the weight of the padding bath.

The finishing agents may be applied to the textile fabric in any known and convenient manner, e.g., by dipping or padding, and will generally be applied from aqueous or alcoholic solution. The solvent may be water; an aliphatic alcohol, e.g., methanol, ethanol, or isopropanol; or a mixture of water and an aliphatic alcohol. Other conventional additives such as lubricants, softeners, bodying agents, water repellents, flame retardants, soil shedding agents, mildew inhibitors, anti-wet soiling agents, fluorescent brighteners, and the like may be used in the treating bath in conventional amounts. Such auxiliaries must not, however, interfere with the proper functioning of the finishing compositions, must not themselves have a deletrious effect on the fabric, and desirably are free of formaldehyde.

The amount of treating agent which is applied to the fabric will depend upon the type of fabric and its intended application. In general it is about 0.5 to 10 percent, and preferably about 2 to 5 percent, based on the weight of the fabric.

In the process of treating fabrics with the blends of this invention, the fabric is impregnated with an aqueous or alcoholic solution of the finishing resins, and the impregnated fabric is then dried and cured; the drying and curing steps may be consecutive or simultaneous.

If desired, the textile fabric may be finished by post-curing (also known as deferred or delayed curing). This consists of impregnating the fabric with a solution of the finishing resins and catalyst, drying the impregnated material carefully so that the finishing agent does not react, and then, after a prolonged interval, heating the material to a temperature at which the agent reacts under the influence of the catalyst.

Although this invention will be described with the use of a mixture of DMDHEU and the product of the reaction of a cyclic urea and glyoxal as a textile finishing agent, it is not intended to be limited thereto. It is also suitable for use as an insolubilizer for binders in paper coatings; a dry-strength or a wet-strength resin in paper; a hand-builder in textiles; a binder in particleboard, medium-density fiberboard, plywood, foundry and shell moldings, insulation materials including glass fiber mats, friction materials, coated and bonded abrasives, etc.; a component in molding compounds; an adhesive for wood and laminates; a filmforming resin in coatings and printing inks; an additive in fibers, e.g., rayon; an additive in rubber processing; an agent in leather tanning; a textile size; a dry fixative for textiles; an impregnant for filters, e.g., automotive filters; and the like.

In order that the present invention may be more fully understood, the following examples are given by way of illustration. No specific details contained therein should be construed as limitations on the present invention except insofar as they appear in the appended claims. Unless otherwise specified, all parts and percentages are by weight.

EXAMPLE 1

176 Parts (2.0 moles) of ethylene urea was added to 290 parts (2.0 moles) of a 40% aqueous solution of glyoxal, and the pH was adjusted to 6.5 with sodium bicarbonate. The mixture was heated to 55°±5° C. and the temperature was held for two hours, maintaining the pH between 6.0 and 7.0. A steady increase in viscosity was observed. At the end of two hours, 187 parts of water was added to adjust the solids to 45%, and the mixture was cooled to 30° C.

The product was a clear viscous material, water-white to light straw colored, with negligible odor. The reaction was essentially complete, as determined by IR and NMR analyses.

EXAMPLE 2

290 Parts (2 moles) of a 40% aqueous solution of glyoxal was adjusted to pH 6.5 with sodium bicarbonate. 176 Parts (2.0 moles) of ethylene urea was added and the temperature raised to 55°±5° C. The mixture was stirred at this temperature for two hours, maintaining the pH between 6.0 and 7.0. After two hours 200 parts (6.25 moles) of methanol was added and the pH adjusted to about 3.0 with concentrated sulfuric acid. The reaction was held at reflux for three hours to effect methylation, the resin solution cooled to 30° C., and the pH adjusted to about 7.0 with a 25% solution of caustic soda.

The product was a clear viscous liquid, pale yellow, with negligible odor. The reaction was essentially complete, as determined by IR and NMR analyses. IR analysis indicated that methylation had occurred.

EXAMPLE 3

360 Parts (2.5 moles) of a 40% aqueous solution of glyoxal was added to 905 parts (2.5 moles) of a 44% methanol solution of dimethyl methoxy propylene urea. The mixture was heated to 55°±5° C. for two hours, the pH being maintained between 6.0 and 7.0. After cooling to 30° C. there was obtained a 45%-solids, slightly viscous, water-white solution with no odor of formaldehyde. The reaction was essentially complete, as determined by IR and NMR analyses.

EXAMPLE 4

The procedure of Example 1 was repeated except that the glyoxal was reacted with each of the following instead of ethylene urea: propylene urea, uron, tetrahydro-5-(2-hydroxyethyl)-1,3,5-triazin-2-one, and 4,5-dihydroxy-2-imidazolidinone. The results were comparable.

EXAMPLE 5

The resin product of Example 1 was used in varying amounts with several catalysts to treat 100% cotton fabric, and the test results are summarized below. In each case the solution of resin and catalyst was applied to samples of the fabric by padding with a wet pickup of about 63%, based on the weight of the fabric. The treated fabrics were dried, and the resin cured on the fabrics by heating for 3 minutes at 150° C., 163° C., and 177° C.

Wrinkle Recovery was measured by AATCC Test Method 66–1978 "Wrinkle Recovery of Fabrics: Recovery Angle Method."

Tensile was measured by ASTM Test Method D-1682-64 (Reapproved 1975) "Tensile-Grab-CRT Pendulum Type".

TABLE I

| | (a) | (b) | (c) | (d) | (e) | (f) | (g) |
|---|---|---|---|---|---|---|---|
| Reactant, parts | | | | | | | |

TABLE I-continued

| | (a) | (b) | (c) | (d) | (e) | (f) | (g) |
|---|---|---|---|---|---|---|---|
| A | 10.0 | 10.0 | 10.0 | 10.0 | 15.0 | 20.0 | |
| B | | | | | | | 10.0 |
| Catalyst, parts | | | | | | | |
| KR | 3.0 | | | | | | 3.0 |
| 531 | | 3.0 | | | 4.5 | 6.0 | |
| X-4 | | | 2.5 | | | | |
| Zinc fluoborate | | | | 2.5 | | | |
| Sulfanole ® RWD | 0.25 | 0.25 | 0.25 | 0.25 | 0.25 | 0.25 | 0.25 |

A is the product of Example 1.
B is 1,3-bishydroxymethyl-4,5-dihydroxy-2-imidazolidinone (45% aqueous solution).
Sulfanole ® RWD (Sun Chemical Corporation) is a non-ionic wetting agent.
Catalyst KR (Sun Chemical Corporation) is a magnesium chloride catalyst.

Catalyst 531 (Sun Chemical Corporation) is an activated magnesium chloride catalyst.

Catalyst X-4 (Sun Chemical Corporation) is a zinc nitrate catalyst.

TABLE II

| | (a) | (b) | (c) | (d) | (e) | (f) | (g) | (h) |
|---|---|---|---|---|---|---|---|---|
| Tensile | | | | | | | | |
| Cured | | | | | | | | |
| at 150° C. W | 86 | 78 | 79 | 54 | 59 | 62 | 72 | 92 |
| F | 31 | 27 | 32 | 18 | 21 | 16 | 28 | 34 |
| Cured | | | | | | | | |
| at 163° C. W | 65 | 76 | 76 | 33 | 38 | 41 | 59 | 90 |
| F | 27 | 20 | 23 | 10 | 11 | 15 | 16 | 27 |
| Cured | | | | | | | | |
| at 117° C. W | 40 | 50 | 54 | 34 | 33 | 40 | 50 | 93 |
| F | 18 | 19 | 20 | 11 | 9 | 9 | 21 | 38 |
| Wrinkle | | | | | | | | |
| Recovery | | | | | | | | |
| Cured | | | | | | | | |
| at 150° C. | | | | | | | | |
| initial | 225 | 237 | 236 | 257 | 264 | 272 | 254 | 210 |
| after 5 AHL | 194 | 187 | 203 | 218 | 200 | 229 | 211 | 166 |
| Cured | | | | | | | | |
| at 163° C. | | | | | | | | |
| initial | 228 | 232 | 234 | 257 | 261 | 272 | 265 | 206 |
| after 5 AHL | 192 | 195 | 191 | 211 | 212 | 228 | 235 | 193 |
| Cured | | | | | | | | |
| at 177° C. | | | | | | | | |
| initial | 229 | 240 | 238 | 248 | 261 | 270 | 270 | 207 |
| after 5 AHL | 214 | 198 | 208 | 226 | 230 | 245 | 248 | 196 |

AHL is average home launderings.
(a) through (g) are fabrics treated with the solutions of Example 1.
(h) is untreated 100% cotton fabric.

From these data it can be seen that the fabrics treated with the products of this invention (a) through (f) are comparable in tensile strength and wrinkle recovery to fabrics treated with the commercial formaldehyde-containing agent (g) and have the advantage of being free of formaldehyde.

EXAMPLE 6

The procedure of Example 5 was repeated with the resin product of Examples 2, 3, and 4. The results were comparable.

EXAMPLE 7

An aqueous solution containing 15.0 parts of the resin product of Example 2 and 4.0 parts of Catalyst 531 (an activated magnesium chloride catalyst) was applied to samples of 65/35 polyester/cotton fabric by padding. The treated fabrics were dried; the resin cured on the fabrics by heating for 5 minutes at 150° C., 5 minutes at 177° C., and 1 minute at 193° C.; and the fabric smoothness determined by AATCC Test Method 124–1978 "Appearance of Durable Press Fabrics after Repeated Home Launderings". The results are tabulated below:

TABLE III

| | (a) | (i) |
|---|---|---|
| Fabric Smoothness | | |
| after 1 AHL | | |
| 150° C. | 3.7 | 3.2 |
| 177° C. | 3.6 | 3.1 |
| 193° C. | 3.4 | 3.0 |
| after 5 AHL | | |
| 150° C. | 3.5 | 3.1 |
| 177° C. | 3.7 | 3.1 |
| 193° C. | 3.6 | 3.1 |
| after 10 AHL | | |
| 150° C. | 3.4 | 3.2 |
| 177° C. | 3.8 | 3.2 |
| 193° C. | 3.8 | 3.2 |

(i) is untreated 65/35 polyester/cotton fabric.

The whiteness of the fabric was good and the fabric showed no chlorine scorch either initially or after 5 launderings.

EXAMPLE 8

The following solutions were prepared, applied to 100% cotton and wrinkle recovery measured as in Example 5:

TABLE IV

| | (a) | (b) | (j) | (k) | (h) |
|---|---|---|---|---|---|
| Reactant, parts | | | | | |
| A | 10.0 | 10.0 | | | |
| C | | | 10.0 | 10.0 | |
| Catalyst, parts | | | | | |
| KR | 3.0 | | 3.0 | | |
| 531 | | 3.0 | | 3.0 | |
| Sulfanole ® RWD | 0.25 | 0.25 | 0.25 | 0.25 | |
| Wrinkle Recovery | | | | | |
| initial | | | | | |
| 150° C. | 232 | 248 | 214 | 195 | 175 |
| 163° C. | 229 | 245 | 204 | 207 | 176 |
| 177° C. | 235 | 250 | 207 | 202 | 178 |

A is the product of Example 1.
C is the product of the reaction of stoichiometric amounts of glyoxal and dimethyl urea (disclosed in U.S. Pat. No. 3,260,565).
(h) is untreated 100% cotton fabric.

From these data it can be seen that fabrics treated with the products of this invention (a) and (b) have considerably better wrinkle recovery than do fabrics treated with the reactant disclosed in U.S. Pat. No. 3,260,565 (j) and (k).

EXAMPLE 9

The procedure for Example 5 was repeated with each of the following fabrics instead of 100% cotton; 50/50 polyester/cotton, 65/35 polyester/cotton, 50/50 polyester/rayon, and 65/35 polyester/rayon. The results were comparable.

EXAMPLE 10

A sample of 65/35 polyester/cotton fabric was impregnated with an aqueous solution containing 20 parts of the product of Example 2, 5 parts of Catalyst KR, and 0.25 part of Sulfanole RWD. The fabric was then dried at 100° C. and stored at elevated temperature for several weeks. A crease was then pressed into the fabric, and it was cured for 15 minutes at 150° C. The fabric was washed and evaluated by AATCC Test Method 88C–1975 "Appearance of Creases in Wash-and-Wear Items after Home Laundering". It had an appearance rating of 5 as compared with a blank having a rating of 3.

EXAMPLE 11

The product of Example 2 was mixed with varying amounts of methylated dimethylol dihydroxyethylene urea (MeDMDHEU) and used to treat 100% cotton fabric. The resins were cured on the fabric by heating for 4 minutes at 163° C. The results are tabulated below:

TABLE V

| | (l) | (m) | (n) | (o) | (p) |
|---|---|---|---|---|---|
| Reactants, parts | | | | | |
| D | 15 | | 10 | 5 | |
| E | | 15 | 5 | 10 | |
| Catalyst 531, parts | 4 | 4 | 4 | 4 | |
| Sulfanole RWD, parts | 0.25 | 0.25 | 0.25 | 0.25 | |
| Tensile W | 32 | 42 | 42 | 35 | 92 |
| F | 11 | 13 | 15 | 17 | 39 |
| Wrinkle recovery | | | | | |
| initial | 203 | 249 | 224 | 247 | 158 |
| after 5 AHL | 224 | 255 | 238 | 248 | 171 |

D is the product of Example 2.
E is MeDMDHEU.
(p) is untreated 100% cotton fabric.

From these data it can be seen that fabrics treated with mixtures of the alkylated glyoxal/cyclic urea condensate and the MeDMDHEU(n) and (o) have tensile strengths and wrinkle recoveries that are comparable to those treated with MeDMDHEU alone (m) and better than those treated with the condensate alone (l). The fabrics have a very slight odor, indicating the presence of only a small amount of free formaldehyde.

EXAMPLE 12

Aqueous solutions of the product of Example 2 and varying amounts of MeDMDHEU with 4 parts of Catalyst 531 and 0.25 part of Sulfanole RWD were applied to samples of 65/35 polyester/cotton fabric by padding. The treated fabrics were dried, the resins cured on the fabrics by heating for 4 minutes at 163° C., and the fabric smoothness determined. The results are tabulated below:

TABLE VI

| | (l) | (m) | (n) | (o) | (q) |
|---|---|---|---|---|---|
| Fabric smoothness | | | | | |
| after 1 AHL | 3.2 | 3.8 | 3.2 | 3.7 | 3.1 |
| after 5 AHL | 3.5 | 3.8 | 3.5 | 3.8 | 3.2 |
| after 10 AHL | 3.5 | 4.0 | 3.7 | 3.8 | 3.3 |

(q) is untreated 65/35 polyester/cotton fabric.

The smoothness of fabrics treated with mixtures of the alkylated glyoxal/cyclic urea condensate and MeDMDHEU (n) and (o) was comparable to that of the fabric treated with MeDMDHEU alone (m) and better than that of the fabric treated with condensate alone (l). The treated fabrics had a very slight odor of formaldehyde.

EXAMPLE 13

The procedure of Example 11 was repeated except that the product of Example 3 was used instead of the product of Example 2. The results are tabulated below:

TABLE VII

| | (r) | (m) | (s) | (t) | (u) | (v) | (w) |
|---|---|---|---|---|---|---|---|
| Reactants, parts | | | | | | | |
| F | 15 | | 12 | 10 | 7.5 | 5 | 3 |
| E | | 15 | 3 | 5 | 7.5 | 10 | 12 |
| Catalyst 531, parts | 3.75 | 3.75 | 3.75 | 3.75 | 3.75 | 3.75 | 3.75 |
| Sulfanole RWD, parts | 0.25 | 0.25 | 0.25 | 0.25 | 0.25 | 0.25 | 0.25 |
| Tensile W | 44 | 42 | 50 | 49 | 47 | 45 | 44 |
| F | 20 | 13 | 18 | 20 | 16 | 17 | 14 |
| Wrinkle recovery | | | | | | | |
| initial | 185 | 249 | 217 | 226 | 243 | 238 | 240 |
| after 5 AHL | 193 | 255 | 211 | 218 | 236 | 243 | 237 |

F is the product of Example 3.
E is MeDMDHEU.

Fabrics treated with a mixture of the alkylated glyoxal/cyclic urea condensate and MeDMDHEU (s), (t), (u), (v), and (w) have tensile strengths that are comparable to that treated with the condensate alone (r) or the MeDMDHEU (m) alone and wrinkle recoveries that are comparable to that treated with the MeDMDEU alone and better than the fabric treated with the condensate alone. The fabrics have a very slight odor, indicating the presence of only a small amount of free formaldehyde.

EXAMPLE 14

The procedure of Example 12 was repeated except that the product of Example 3 was used instead of the product of Example 2. The results are tabulated below:

TABLE VIII

| | (r) | (m) | (s) | (t) | (u) | (v) | (w) |
|---|---|---|---|---|---|---|---|
| Fabric smoothness | | | | | | | |
| after 1 AHL | 4.0 | 3.8 | 4.7 | 4.3 | 4.5 | 4.4 | 4.2 |
| after 5 AHL | 4.0 | 3.8 | 4.25 | 4.2 | 4.8 | 4.25 | 4.6 |
| after 10 AHL | 3.9 | 4.0 | 3.8 | 4.0 | 4.1 | 3.9 | 3.9 |

The smoothness of fabrics treated with blends of the alkylated glyoxal/cyclic urea condensate (s), (t), (u), (v), and (w) is better than that of fabrics treated with the condensate alone (r) or the MeDMDHEU alone (m). The treated fabric had only a slight odor of formaldehyde.

EXAMPLE 15

The precedures of Examples 11, 12, 13 and 14 were repeated with DMDHEU instead of MeDMDHEU. The results were comparable.

EXAMPLE 16

The procedures of Examples 11 and 12 were repeated with the product of Example 1 instead of with the product of Example 2. The results were comparable.

EXAMPLE 17

The procedures of Examples 11 and 12 were repeated with blends of the product of Example 1 and DMDHEU instead of blends of the product of Example 2 and MeDMDHEU. The results were comparable.

What is claimed is:

1. A composition for treating a textile fabric containing cellulosic fibers which comprises a blend of (1) a glyoxal/cyclic urea condensate or an alkylated derivative thereof and (2) dimethylol dihydroxyethylene urea or an alkylated derivative thereof.

2. The composition of claim 1 wherein the ratio of amounts of (1):(2) is about 1:0.1–5.

3. The composition of claim 1 wherein the ratio of amounts of (1):(2) is about 1:0.2–4.

4. The composition of claim 1 wherein (1) is a glyoxal/cyclic urea condensate and (2) is dimethylol dihydroxyethylene urea.

5. The composition of claim 1 wherein (1) is an alkylated glyoxal/cyclic urea condensate and (2) is an alkylated dimethylol dihydroxyethylene urea.

6. The composition of claim 1 wherein (1) is a glyoxal/cyclic urea condensate and (2) is an alkylated dimethylol dihydroxyethylene urea.

7. The composition of claim 1 wherein (1) is an alkylated glyoxal/cyclic urea condensate and (2) is dimethylol dihydroxyethylene urea.

8. A process for producing crease-resistant textile fabrics which comprises impregnating a textile containing cellulosic fibers with a solution of the blend of claim 1 and a catalyst and heating the impregnated textile to cure the reactant thereon.

9. A crease-resistant textile fabric containing cellulosic fibers produced by the process of claim 8.

* * * * *